US006327452B1

(12) United States Patent
Jaskowiak et al.

(10) Patent No.: US 6,327,452 B1
(45) Date of Patent: Dec. 4, 2001

(54) DONOR ROLLS AND METHODS OF MAKING DONOR ROLLS

(75) Inventors: Timothy R. Jaskowiak; Ann M. Kazakos; Joy L. Longhenry, all of Webster; Michelle L. Schlafer, Fairport; Grethel K. Mulroy, Pittsford; Thomas L. DiGravio, Ontario; Kevin H. Taft, Williamson; Frederick B. White, Farmington; Mark Gelin, Penfield, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/503,937

(22) Filed: Feb. 14, 2000

(51) Int. Cl.[7] ..... G03G 15/08
(52) U.S. Cl. ..... 399/286; 492/18; 492/28
(58) Field of Search ..... 399/265, 266, 399/279, 286, 290, 291; 492/11, 17, 18, 28

(56) References Cited

U.S. PATENT DOCUMENTS

| | | | | |
|---|---|---|---|---|
| Re. 35,698 | | 12/1997 | Behe et al. . | |
| 4,603,634 | * | 8/1986 | Fadner | 101/487 |
| 4,716,134 | | 12/1987 | Yamaguchi et al. . | |
| 4,830,996 | | 5/1989 | Hirai et al. . | |
| 4,893,151 | | 1/1990 | Yamazaki et al. . | |
| 4,897,374 | | 1/1990 | Matsumoto et al. . | |
| 5,219,809 | | 6/1993 | Kato et al. . | |
| 5,245,392 | | 9/1993 | Behe et al. . | |
| 5,253,016 | | 10/1993 | Behe et al. . | |
| 5,300,339 | | 4/1994 | Hays et al. . | |
| 5,322,970 | | 6/1994 | Behe et al. . | |
| 5,324,248 | * | 6/1994 | Quigley | 492/50 |
| 5,338,893 | | 8/1994 | Edmunds et al. . | |
| 5,384,627 | | 1/1995 | Behe et al. . | |
| 5,473,418 | | 12/1995 | Kazakos et al. . | |
| 5,563,690 | | 10/1996 | Hasegawa et al. . | |
| 5,600,414 | | 2/1997 | Hyllberg . | |
| 5,707,326 | | 1/1998 | Hyllberg . | |
| 5,805,968 | | 9/1998 | Chatterjee et al. . | |
| 5,950,051 | * | 9/1999 | Casella | 399/164 |
| 6,154,626 | * | 11/2000 | Litman et al. | 399/282 |

* cited by examiner

*Primary Examiner*—Robert Beatty
(74) *Attorney, Agent, or Firm*—Oliff & Berridge, PLC

(57) ABSTRACT

A roller includes a core and a ceramic coating formed over the core. The roller has a composite runout of less than 20 $\mu$m and a total indicator reading runout of less than 7 $\mu$m. The ceramic coating has a smooth finish and has controlled electric properties. This roller can be used as a donor roller for transporting toner to a photoconductive member so as to achieve high-quality image development.

39 Claims, 10 Drawing Sheets

DONOR ROLLS AND METHODS OF MAKING DONOR ROLLS

BACKGROUND OF THE INVENTION

1. Field of Invention

This invention relates to electrostatographic imaging devices.

2. Description of Related Art

Electrostatic reproduction and printing involves uniformly charging a photoconductive member, or photoreceptor, and imagewise discharging it, or imagewise exposing it, based on light reflected from, or otherwise representing, an original image being reproduced or printed. The result is an electrostatically-formed latent image on the photoconductive member. The latent image is developed by bringing a charged developer material into contact with the photoconductive member to form a toner powder image. The toner powder image is transferred to a receiving sheet and then fused by heating.

This process can be modified to form color images. One type of process, called image-on-image processing, superimposes toner powder images of different color toners onto the toner prior to the transfer of the composite toner powder image onto the substrate.

Two-component and single-component developer materials are known. Two-component developer materials comprise magnetic carrier particles and charged toner particles that adhere triboelectrically to the carrier particles and arc intended to adhere the photoconductive member.

Single-component developer material typically include only toner particles. The toner particles typically have an electrostatic charge to adhere to the photoconductive member, and magnetic properties to magnetically convey the toner particles from the sump to the developer roll. The toner particles adhere directly to the developer roll. The toner particles are attracted to the donor roll from a magnet or developer roll. From the donor roll, the toner is transferred to the photoconductive member in the development zone.

For both types of developer material, the charged toner particles are brought into contact with the latent image to form a toner image on the photoconductive member. The toner image is transferred to a receiver sheet, which passes through a fused device where the toner particles are heated and permanently fused to the sheet, forming a hard copy of the original image.

A development device is used to bring the charged toner particles into contact with the latent image formed on the photoreceptor, so that the toner particles adhere electrostatically to the charged areas on the latent image. The development device typically includes a chamber in which the developer material is mixed and charged.

One type of two-component development method and apparatus is known as "scavengeless development." "Hybrid" scavengeless development apparatus typically include a mixing chamber that holds a two-component developer material, at least one developer material developer or magnetic roll, a donor roll, a development zone, and an electrode structure at the development zone between the donor roll and the photoconductive member. The donor roll receives charged toner particles from the developer roll and transports the particles to the development zone. An AC voltage is applied to the electrodes to form a toner cloud in the development zone. Electrostatic fields generated by an adjacent latent image on the photoconductive member surface attract charged toner particles from the toner cloud to develop the latent image on the photoconductive member.

Another variation on scavengeless development uses single-component developer material development systems. As in two-component developer material development systems, the donor roll and electrodes also create a toner cloud.

SUMMARY OF THE INVENTION

In both one-component and two-component developer scavengeless development systems, the development apparatus should be able to effectively and controllably transport toner particles into the development zone and donate the charged toner particles to the photoconductive member, to achieve high-quality image development.

In scavengeless development systems, an important factor in achieving effective and controllable transfer of charged toner particles from the donor roll to the photoconductive member is the dimensional control of the components that are involved in the transfer function. The macrouniformity is the result of the accumulated tolerance of these components. Typically, the components include the donor roll, the photoconductive member, such as a photoreceptor belt, and a backerbar that contacts the photoreceptor belt's inner surface opposite to the outer surface to which the toner is transferred.

For proper operation of the donor roll in a hybrid scavengeless development system, the diameter tolerance, runout and surface finish of the donor roll should be as precise as possible. Donor rolls are typically formed by machining a cylindrical body from solid cylindrical stock material, and forming a bore in each of the opposed end faces of the body. Journals are formed from smaller cylindrical stock material and fitted into the bores at both ends of the body. The journals are mounted to bearings to allow for rotation of the roll.

The outer peripheral surface of the body should have a precision size, roundness and runout requirements with respect to the journals. As the roll is rotated about the journals, the outer periphery of the roll may have an eccentric pattern or runout with respect to the journals. The total runout of the donor roll includes the runout between the periphery of the body and counterbore inside diameter, the roundness of the body, and the roundness of the journals.

Also, if the donor roll is mounted so that it rotates about an axis that does not coincide with its true geometrical axis, runout can occur. Likewise, if the donor roll dimensions are not sufficiently uniform and the donor roll and/or journals are rounded, runout can still occur even if the donor roll is properly mounted to rotate about its true geometrical axis. Thus, to reduce runout of the donor roll, its dimensions and dimensional uniformity should be as precise as possible, and the donor roll should be mounted to rotate as closely as possible about its true geometrical axis.

As stated, the runout of the donor roll causes a deviation of the periphery of the donor roll as it rotates. If the donor roll has excessive runout, it can change the size of the development zone along the length of the donor roll by the amount of the runout.

In addition to the tolerances of the donor roll, the tolerances of the backerbar, photoconductive member and other components involved in the transfer of toner from the donor roll to the photoconductive member contribute to the macrouniformity in the development zone.

If the development zone of the development apparatus changes excessively during imaging due to poor dimensional control of the components, then the ability of the apparatus to effectively and controllably donate charged toner particles to the photoconductive member and achieve high-quality image development can be adversely affected. Particularly, if the total allowable deviations or the development zone nonuniformity of the components involved in the transfer of the charged toner particles from the donor roll to the photoconductive member is too high such that gap non-uniformity occurs then toner may conceivably not deposit uniformly.

In order to reduce or even prevent the occurrence of this condition or nonuniformity and to achieve improved image quality, the tolerances of the components including the donor roll, photoconductive member and backerbar need to be reduced. Decreasing the runout and increasing the dimensional uniformity of the donor roll would improve the dimensional control of the components involved in the toner transfer from the donor roll to the photoconductive member. In addition, decreasing the runout and increasing the dimensional uniformity of the donor roll would relax the required tolerances of the other components in order to achieve a desired total tolerance and thus would provide increased latitude in the design and manufacture of the other components.

The donor roll should also have other electrical, chemical and physical characteristics that enable charged toner particles to effectively and controllably adhere electrostatically to the donor roll's outer surface and to be donated to the photoconductive member.

Another desirable characteristic of the donor roll is that it has an outer surface with a smooth finish or low roughness. It is also desirable that the outer surface of the donor roll have good machining characteristics so that it can be finished in less time and with reduced cost.

The donor roll outer surface should also have sufficient wear resistance to resist abrasion when contacted by other surfaces.

This invention also provides rolls that have ceramic coatings with physical, electrical and chemical properties that enable charged toner particles to effectively and controllably adhere electrostatically to the donor roll, and to be effectively donated to a photoconductive member to form images.

This invention separately provides rolls that have minimal runout and improved dimensional uniformity.

This invention separately provides rolls having ceramic coatings with tunable electrical properties.

This invention separately provides rolls having a ceramic coating with a highly smooth finish.

This invention separately provides rolls having a ceramic coating with improved machining characteristics.

This invention separately provides rolls having a wear resistant outer surface.

This invention separately provides rolls having a ceramic coating with a highly uniform thickness.

This invention separately provides apparatus and methods of making rolls with these and other desirable characteristics.

Exemplary embodiments of the rolls according to this invention comprise a core and a ceramic coating formed over the core. The rolls have minimal runouts. The ceramic coatings also have highly uniform dimensions. The rolls can be used in developing apparatus, such as hybrid scavengeless developing apparatus, to improve macrouniformity of the developing apparatus and thus improve development performance.

In some exemplary embodiments of the rolls according to this invention, the ceramic coating can consist essentially of a single ceramic material. In other exemplary embodiments, the ceramic coating can comprise blends of ceramic materials.

The ceramic coatings formed on the rolls can provide a smooth finish and controlled electrical properties. These and other properties of the ceramic coatings make the rolls highly suitable for use in various electrostatographic imaging apparatus.

Exemplary embodiments of the methods of forming the rolls according to this invention comprise forming a ceramic coating over a core, and finishing the ceramic coating to achieve rolls having a reduced runout.

The reduced runout of the rolls can be achieved by improved fixturing and by close control of the machining parameters used to prepare the core for coating and to finish the surface of the ceramic coating formed on the core, and also by close control of the coating parameters.

The ceramic coatings can be formed over the cores by any suitable coating process that can produce ceramic coatings with the desired properties. Suitable coating processes include thermal spraying processes. In some exemplary embodiments of the methods according to this invention, the ceramic coating can be formed by a high-velocity oxy-fuel (HVOF) process.

This invention also provides methods of coating the core that can apply a facecoat to the faces of the core with substantially no overspray onto the surface of the core extending between the ends. The surface of the core can be coated with the ceramic coating within the same process used to form the facecoat on the faces.

This invention also provides methods of forming a sublayer between the core and the ceramic coating formed over the core to provide good adhesion of the ceramic coating.

This invention also provides grinding apparatus that can be used to form improved ceramic coatings on the rolls.

BRIEF DESCRIPTION OF THE DRAWINGS

Various exemplary embodiments of this invention will be described in detail, with reference to the following figures, in which.

DETAILED DESCRIPTION OF EXEMPLARY EMBODIMENTS

Figure 1:
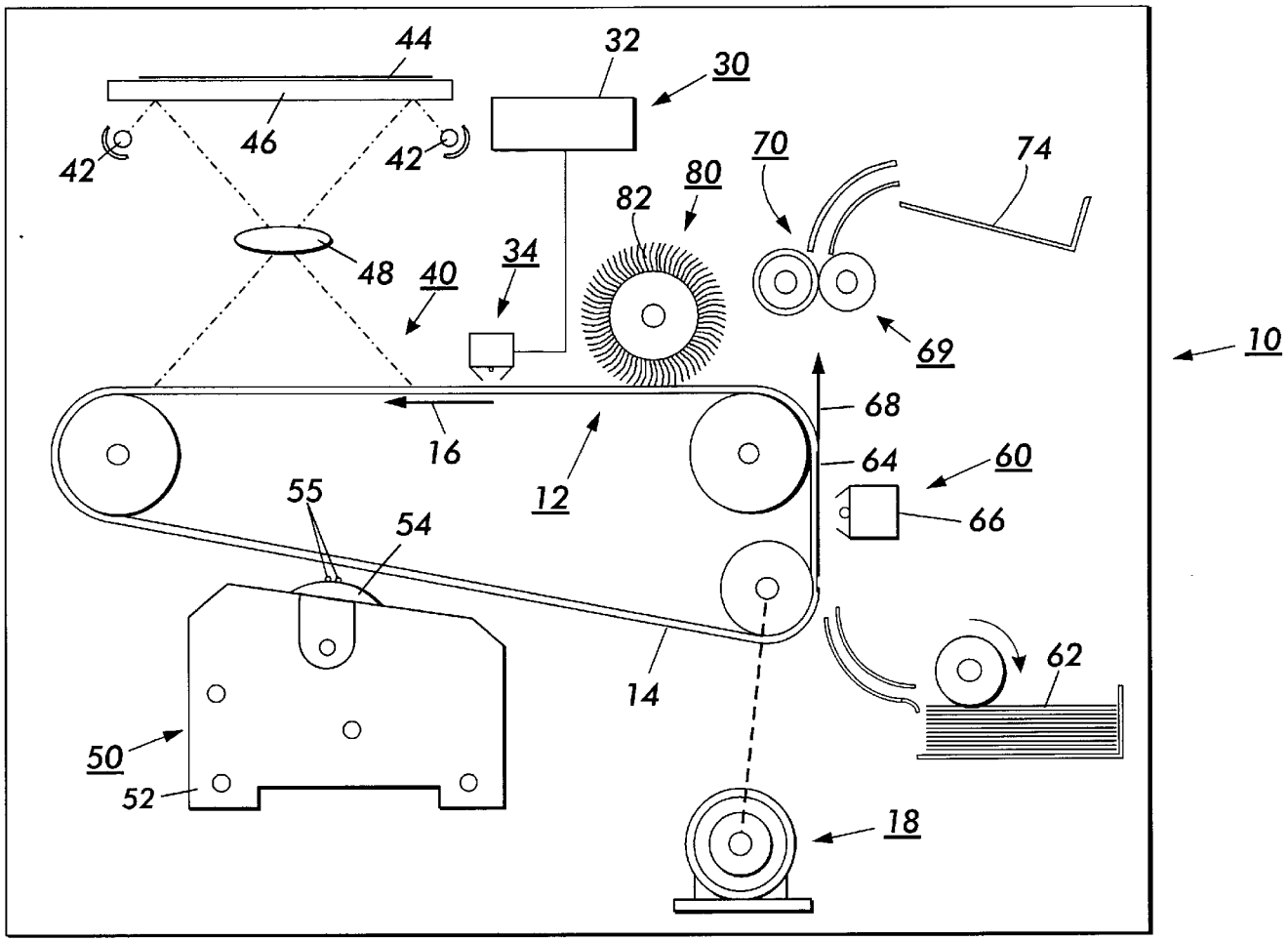
FIG. 1 illustrates a scavengeless electrostatographic development apparatus including an exemplary embodiment of a donor roll according to this invention.

FIG. 1 shows a scavengeless electrostatic imaging apparatus 10 including an exemplary embodiment of a donor roll 54 according to this invention. The imaging apparatus 10 includes an image bearing member in the form of a belt 12 having an outer photoconductive surface 14. The image bearing member can alternatively comprise other types of photoconductive image bearing members, such as a drum having a photoconductive surface. The belt 12 moves in the direction of the arrow 16 to advance successive portions of the photoconductive surface 14 sequentially through various processing stations during the imaging process. The belt 12 is driven by a motor 18.

Initially, a portion of the belt 12 passes through a charging station 30 where a power supply 32 causes a corona generating device 34 to charge a portion of the photoconductive surface 14 of the belt 12.

The charged portion of the belt 12 is advanced to a exposure station 40. At the exposure station 40, one or more light sources such as lamps 42 emit light that is reflected onto an original document 44 seated on a transparent platen 46. The light reflected imagewise from the original image of the document 44 is transmitted through a lens 48. The lens 48 focuses the imagewise light onto the charged portion of the photoconductive surface 14 to selectively dissipate the charge to form a latent image. The latent image formed on the photoconductive surface 14 corresponds to the informational areas contained within the original image of the document 44. For such Imagewise exposure of the photoconductive surface 14 in a digital copier, a laser printer and the like, a raster output scanner (ROS) can alternatively be used instead of the lamps 42 and lens 48.

After the electrostatic latent image is formed on the photoconductive surface 14, the belt 12 advances the latent image to a development station 50. At the development station 50, a development apparatus 52 develops the latent image recorded on the photoconductive surface 14 to form a toner image.

The belt 12 then advances the toner image to a transfer station 60 where a copy sheet 62 is advanced by a sheet feeding apparatus 64 to transfer the toner image to the sheet 62. The transfer station 60 also includes a corona generating device 66, which sprays ions onto the sheet 62 to attract the toner image from the photoconductive surface 14 onto the sheet 62. After this image transfer, the sheet 62 is separated from the belt 12 and moved in the direction of the arrow 68 by rollers 69 to a fusing station 70.

The fusing station 70 includes a fuser assembly that heats, fuses and permanently affixes the toner image to the sheet 62, forming a sheet copy of the original image of document 44. The sheet 62 is then advanced to a tray 74.

The belt 12 moves the portion of the surface 14 from which the image had been transferred to the sheet 62 to a cleaning station 80. The cleaning station 80 can include a brush 82 or the like that rotates in contact with the photoconductive surface 14 to remove the residual toner particles. Next, light is emitted onto the photoconductive surface 14 to dissipate any residual electrostatic charge on the belt 12.

Figure 2:
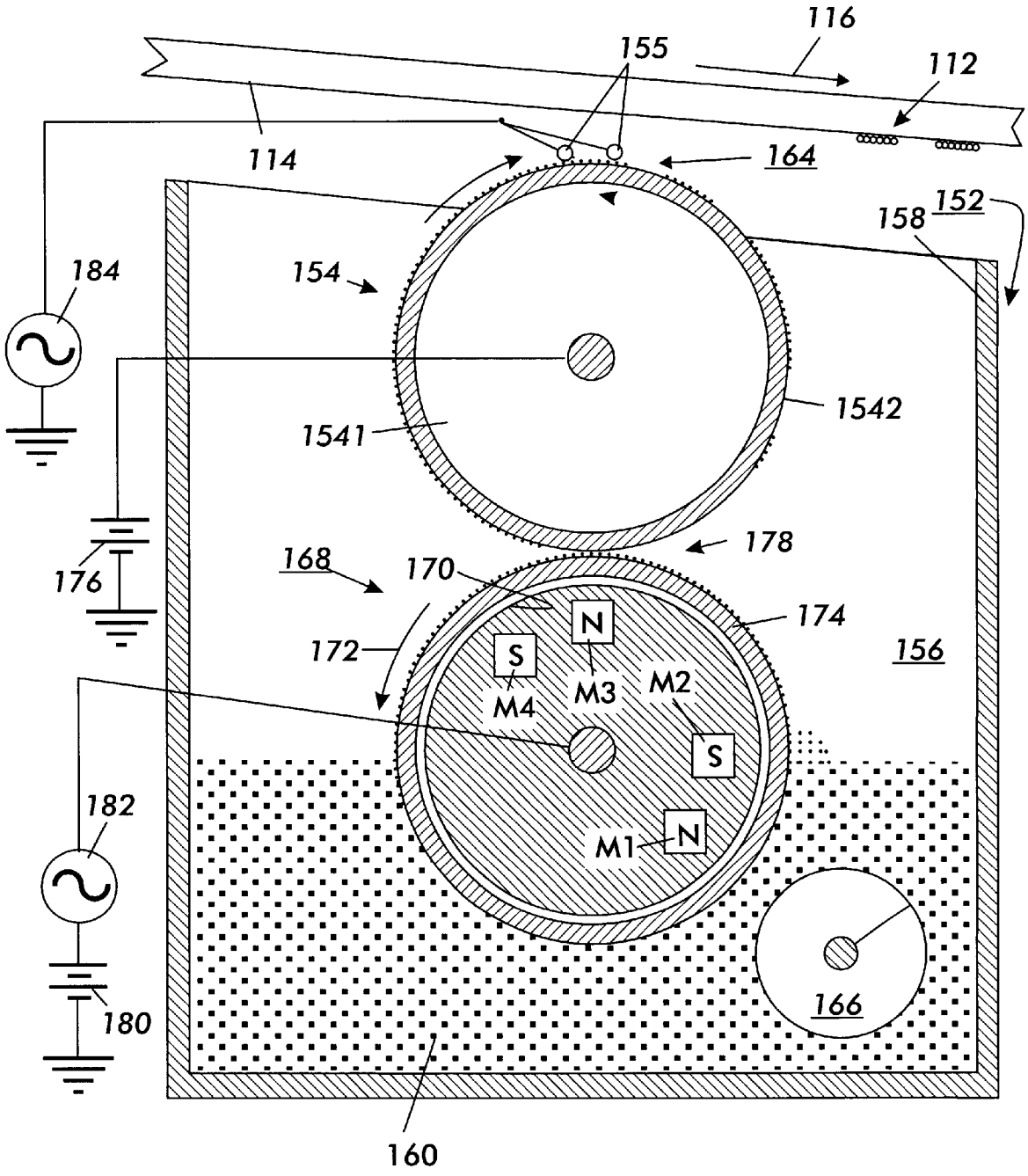
FIG. 2 illustrates a hybrid scavengeless development device including an exemplary embodiment of a donor roll according to this invention.

FIG. 2 shows a hybrid scavengeless two-component development apparatus 152 including an exemplary embodiment of a donor roll 154 according to this invention. The donor roll 154 is mounted partially within a mixing chamber 156 defined by a housing 158. The mixing chamber 156 holds a supply of a two-component developer material 160 comprising toner particles and carrier beads. The donor roll 154 transports toner particles that have been fed from the mixing chamber 156 into contact with electrode wires 155 within a development zone 164 for latent image development. The developer material 160 is moved and mixed within the mixing chamber 156 by a mixing device 166 to charge the carrier beads and toner particles. The oppositely charged toner particles adhere triboelectrically to the charged magnetizable carrier beads.

The development apparatus 152 also includes a developer material feeder assembly, such as a magnetic roll 168 that feeds a quantity of the developer material 160 from the mixing chamber 156 to the donor roll 154. The magnetic roll 168 includes a substrate 170. The substrate 170 rotates in the direction of the arrow 172, and includes a coating 174, and magnetic members M1 to M4. The magnetic roll 168 and the donor roll 154 are electrically biased relative to each other so that charged toner particles of the developer material 160 fed to the donor roll 154 are attracted from the magnetic roll 168 to the donor roll 154. In some other embodiments, the coating 174 is not needed on the substrate 170 to provide the desired transport properties. In addition, the substrate 170 can include a different number of magnetic members than the four magnetic members M1 to M4 in FIG. 2.

As also shown in FIG. 2, the donor roll 154 is biased to a specific voltage by a direct current (DC) power supply 176 so that the donor roll 154 attracts charged toner particles from the magnetic roll 168 in a nip 178. To enhance the attraction of charged toner particles from the mixing chamber 156, the magnetic roll 168 is also biased by a DC voltage source 180. The magnetic roll 168 is also biased by an AC voltage source 182 that temporarily loosens the charged toner particles from the magnetized carrier beads. The loosened charged toner particles are attracted to the donor roll 154. An AC bias is also applied to the electrode wires 155 by an AC voltage source 184 to loosen charged toner particles from the donor roll 154, and to form a toner cloud within the development zone 164.

Other embodiments of the hybrid scavengeless two-component development apparatus 152 can comprise more than one donor roll 154, such as, for example, two donor rolls 154. Such apparatus can also include more than one magnetic roll 168 and more than one mixing device 166.

The donor roll 154 can also be used in scavengeless single-component development apparatus.

Figure 3:
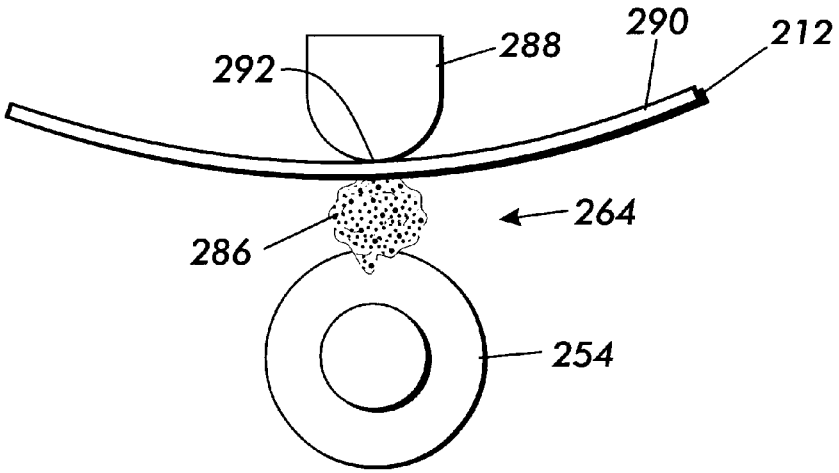
FIG. 3 is an end view showing a portion of the development zone region in a hybrid scavengeless development device.

FIG. 3 shows a portion of the development zone 264, including the belt 212, the donor roll 254 and a toner cloud 286 formed between the belt 212 and donor roll 254. A backerbar 288 contacts the inner surface 290 of the belt 212. During imaging, toner from the toner cloud 286 deposits on the latent image formed on the belt 212.

Figure 4:
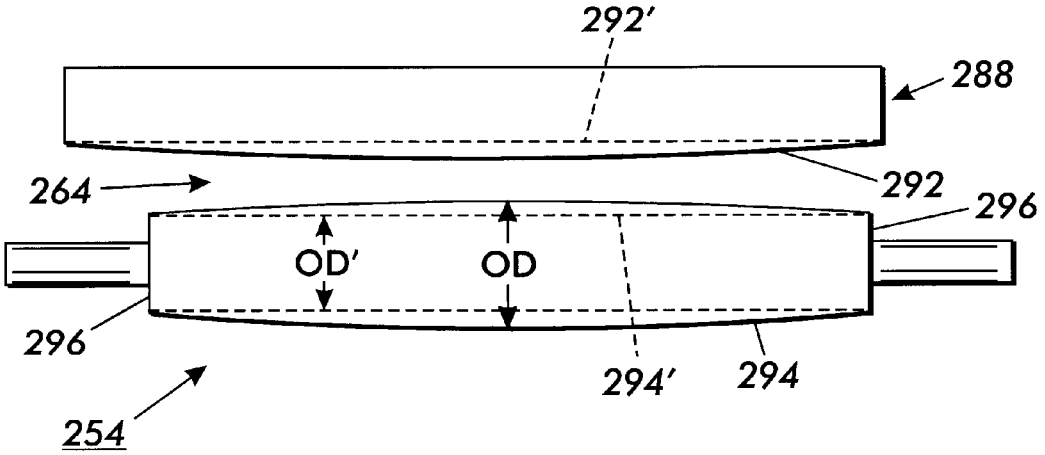
FIG. 4 is a side view of the backerbar and donor roll of FIG. 3.

As described above, the tolerances of the donor roll 254, the belt 212 and the backerbar 288 contribute to the macrounifonmity of the development device. FIG. 4 shows the effect of the longitudinal dimensional non-uniformity of the backerbar 288 and donor roll 254 on the size of the development zone 264. As shown, the backerbar 288 has a surface 292 that contacts the inner surface 290 of the belt 212. To achieve good contact between the surface 292 and the inner surface 290 of the belt 212 along the entire length of the backerbar 288, the surface 292 should be straight as depicted by the dotted line 292'. However, the curved shape of the surface 292 can limit the contact between the surface 292 of backerbar and the inner surface 290 of the belt 212 to only at about the middle region of the backerbar 288 where the maximum curvature occurs.

As also shown in FIG. 4, the donor roll 254 has a curved outer surface 294 and a corresponding outer diameter OD that varies along the length of the donor roll 254. The outer diameter OD is greatest near the middle of the donor roll 254 and decreases toward the opposed ends 296 of the donor roll 254. The outer surface 294 should instead have a constant outer diameter OD' along the length of the donor roll 254 as depicted by the dotted line 294'.

The roundness and dimensional non-uniformity of the backerbar 288 and the donor roll 254 cause the size of the development zone 264 to vary significantly along the lengths of the backerbar 288 and the donor roll 254, and thus along the width of the belt 212.

In addition to the roundness and dimensional non-uniformity of the backerbar 288 and the donor roll 254, the belt 212 can also have some variation in its thickness along its length, which can add to the variation in the size of the development zone 264.

The backerbar 288 and donor roll 254 configurations shown in solid line in FIG. 4 would produce poor development of the belt 212. For example, if the donor roll 254 were used in a scavengeless development apparatus such as the apparatus 152 shown in FIG. 2, the positional relationship between the belt 212 and the toner cloud 286 would vary along the length of the donor roll 254. Particularly, the belt would extend farther toward the toner cloud 286 near the middle portion of the donor roll 254 at which the outer diameter OD is greatest, than at the end portions of the donor roll 254 at which the outer diameter OD decreases toward the opposed ends 296. Consequently, near the middle portion of the donor roll 254, excessive donor deposition may occur on the belt 212. At the end portions of the donor roll 254, full development may not be achieved. Varlations in the thickness of the belt 212 would enhance the non-uniformity of the deposition of the toner on the belt 212.

Figure 5:
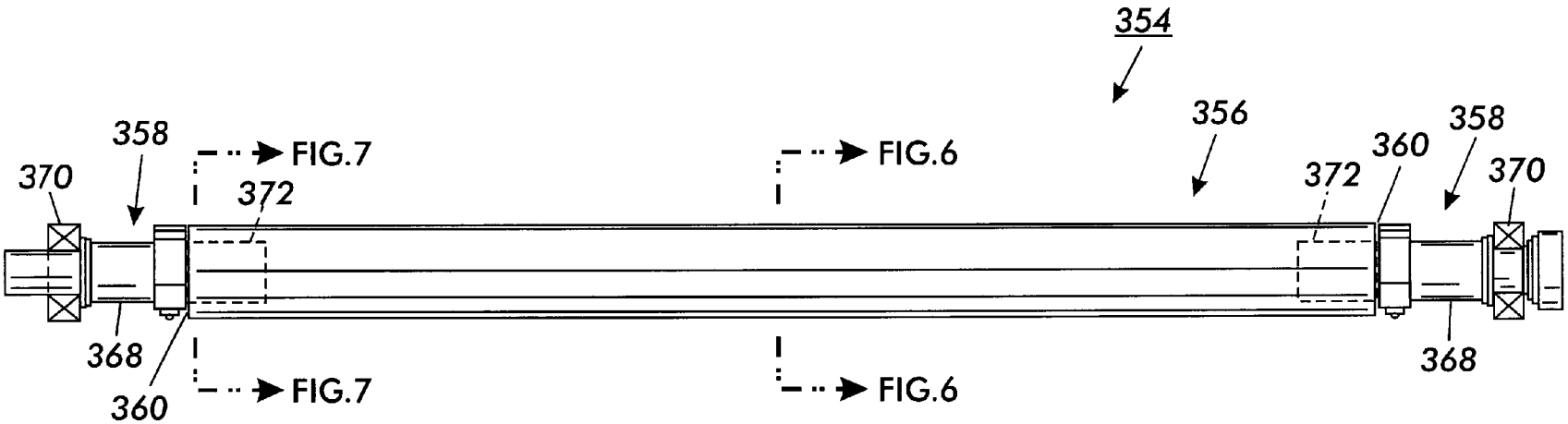
FIG. 5 illustrates an exemplary embodiment of a donor roll according to this invention.
Figure 6:
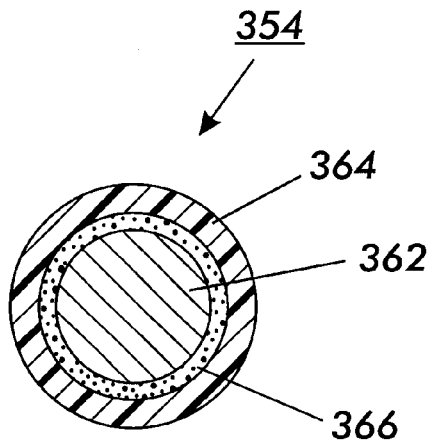
FIG. 6 is a cross-sectional view in the direction of line 6—6 of FIG. 5.
Figure 7:
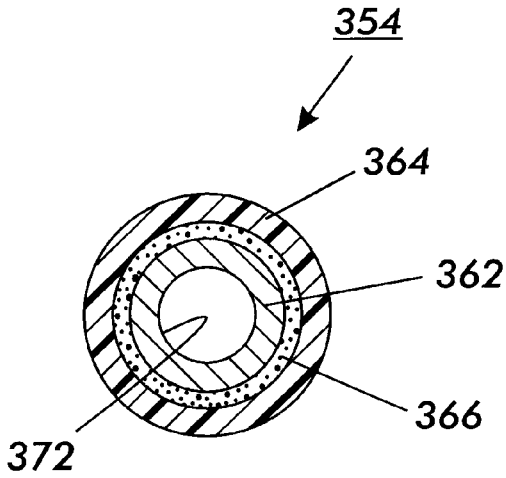
FIG. 7 is a cross-sectional view in the direction of line 7—7 of FIG. 5.

The invention provides donor rolls that have improved dimensional uniformity and reduced runout. An exemplary embodiment of the donor rolls 354 according to this invention is shown in FIGS. 5–7. As shown in FIG. 5, the donor roll includes a body 356 and mounting elements 358.

Referring to FIG. 6, the body 356 includes a core 362 and a ceramic coating 364 formed over the core 362. The core 362 is typically cylindrical shaped and includes a cylindrical surface extending between opposed end faces 360.

The core 362 can comprise any suitable material. The material forming the core 362 should be able to withstand the temperatures that are typically reached during the process of coating the core 362, as described in detail below. The core 362 can be formed, for example, of metallic materials. Ferrous materials such as steels and stainless steels can be used to form the core 362. In addition, the core 362 can be formed of non-ferrous materials such as aluminum and aluminum alloys, and copperbase materials such as brass.

Also, non-metallic materials such as glass, fiber-reinforced resins, composites, ceramics and high-temperature plastics can be used to form the core 362. For these non-metallic materials, the core 362 and ceramic coating 364 are electrically grounded.

The core 362 can be formed by any suitable technique, such as by extruding a conductive metal such as aluminum.

In some embodiments of the donor roll 354, at least one sublayer 366 can be formed between the core 362 and the ceramic coating layer 364. In other embodiments, the ceramic coating 364 can be formed directly on cylindrical surface of the core 362 between the end faces 360.

The mounting elements 358 of the donor roll 354 typically includes journals 368 that are attached to the end faces 360 of the core 362. The journals 368 can be formed by conventional techniques and can comprise any suitable material. Typically, the journals 368 are formed from metals such as stainless steels. Various steps including grinding and turning are typically performed to produce the desired size and configuration of the journals 368 for mounting to the core 362. Typically, the journals 368 are cylindrical shaped.

Bearings 370 are typically mounted on the journals 368 to allow for rotation of donor roll 154.

As shown in dotted line in FIG. 5 and also shown in FIG. 7, bores 372 are formed in the end faces 360 of the core 362. The bores 372 are typically formed by a boring operation, and then cleaned to remove any machining residue. The journals 368 are fitted into the bores 372 by any suitable technique, such as shrink fitting.

After the journals 368 are mounted to the core 362, the core 362 and journals 368 are subjected to a grinding process to provide the desired dimensional requirements to achieve coating thickness uniformity on the core 362 prior to applying the ceramic coating 364 on the cylindrical surface of the core 362. For grinding cores 362 comprising aluminum materials and the metallic journals 368, a grinding element such as a silicon carbide grinding wheel having a suitable grit can be used.

The ceramic coating 364 comprises any suitable ceramic material. In certain exemplary embodiments of the donor roll 354 according to this invention, the ceramic coating 364 consists essentially of a single ceramic component. In such embodiments, stabilized zirconium oxide or zirconia can alone be used to form the ceramic coating 364. Zirconia-containing ceramic coatings for donor rolls are described in U.S. patent application Ser. No. 09/503,936 filed simultaneously herewith, and incorporated herein by reference in its entirety.

The zirconia material forming the ceramic coating 364 can be stabilized by the addition of any suitable stabilizing component. The stabilizing component is added to zirconia in an effective amount to achieve the desired mechanical properties including ductility. Suitable exemplary stabilizing components for zirconia include one of yttria, magnesium oxide, calcia and ceria. Stabilized zirconia has a lower hardness and less erosion resistance than aluminia. Consequently, stabilized zirconia ceramic coatings 364 have improved machining characteristics.

Typically, the stabilizing component in zirconia to form the ceramic coating 364 is included in an amount of from about 5 wt % to about 30 wt % to achieve the desired mechanical properties of the ceramic coating 364.

In some exemplary embodiments of the ceramic coating 364, ceramic coatings 364 that consist essentially of stabilized zirconia can provide the desired electrical properties of the donor roll 354.

In other exemplary embodiments of the ceramic coating 364 according to this invention, the ceramic coating 364 comprises blends of different ceramic materials. For example, the ceramic coating 364 can comprise stabilized zirconia and titanium oxide or titania. In such exemplary embodiments, the ceramic coating 364 comprises at least about 75 wt % of stabilized zirconia and the balance of up to about 25 wt % of titania. In other exemplary embodiments of the ceramic coating 364 according to this invention, the ceramic coating 364 comprises at least about 95 wt % of zirconia and balance of up to about 5 wt % of titania.

The addition of titania further increases the electrical conductivity above that of pure stabilized zirconia. Both zirconia and titania themselves become semi-conductive via thermal spray processes that can be used to form the zirconia/titania ceramic coating 364. Titania achieves a lower level of resistivity, which is the inverse of electrical conductivity, than zirconia. This reduced resistivity may be desirable in some applications of the donor roll 354. Accordingly, the amount of titania in the ceramic coating 364 can be selectively varied to tune the electrical resistivity of the ceramic coating 364 to the desired value.

Other suitable blends of ceramic materials for forming the ceramic coating 364 include blends of alumina and titania. Such alumina/titania blends can comprise from about 10 wt % to about 40 wt % of titania and the balance of the blend being alumina. In some embodiments of the ceramic coating 364, the ceramic coating comprises about 82 wt % alumina and about 18 wt % titania. Varying the amount of titania changes the resistivity of the ceramic coating 364.

The composition of the ceramic coating 364 can be selected to provide the desired electrical properties to the donor roll 354, including electrical resistivity and breakdown voltage protection. Typically, the electrical resistivity of the ceramic coating 364 is from about $10^3$ Ω·cm to about $10^{10}$ Ω·cm. In some exemplary embodiments of the donor roll 354, the ceramic coating 364 has an electrical resistivity of from about $10^6$ Ω·cm to about $10^{10}$ Ω·cm.

Suitable zirconia, alumina and titania materials for forming the ceramic coating 364 are commercially available from the Norton Company of Worchester, Mass. The zirconia, alumina and titania materials are typically provided in powder form. The zirconia, alumina and titania powders can each have a typical particle size of from about 5 μm to about 150 μm. In some exemplary embodiments, these powders can have a particle size of from about 15 μm to about 45 μm. It is desirable that the powders be in a dry condition to provide increased deposition efficiency and coating quality of the ceramic coating 364.

Zirconia provides a smoother surface finish to the ceramic coating 364 than can be achieved using known coating compositions that have been applied on donor rolls, such as coatings having a high percentage of alumina. The surface smoothness of the ceramic coating 364 can be quantitatively characterized by known surface roughness measurement and characterization equipment. In embodiments of the ceramic coating 364, the surface of the ceramic coating 364 can have a maximum waviness Wt of less than about 2 μm and a surface smoothness or arithmetical mean roughness Ra of less than about 1.5 μm after completion of all finishing operations on the ceramic coating 364. In other embodiments of the ceramic coating 364, the surface of the ceramic coating 364 can be even smoother and can have a maximum waviness Wt of less than about 1 μm and a surface smoothness or arithmetical mean roughness Ra of less than about 0.7 μm after all finishing operations on the ceramic coating 364.

The ceramic coatings 364 can be applied onto the core 362 of the donor rolls 354 by any suitable coating process. However, without using a thermal spray process, the desired electrical properties of the ceramic coatings 364 may not be achieved. Insulative titania and zirconia powders are transformed into a semi-conductive coating through the thermal spray process. Accordingly, the ceramic coating 364 is typically applied by a thermal spraying process. For example, the ceramic coating 364 can be applied by plasma spraying. A suitable plasma spraying device for applying the ceramic coating 364 is a Praxair SG100 plasma spray gun commercially available from Praxair Surface Technologies of Appleton, Wis.

Suitable are gases for the plasma spraying process include argon and helium. Hydrogen may also be used. Suitable process parameters, including the gas flow rates, power level, powder feed rate and plasma spraying device standoff distance, can be selected to provide the desired characteristics of the coating 364. The gas flow rates control the velocity of the molten ceramic impinging on the core 362 or sublayer 366 and also the amount of time the ceramic powders are in the plasma, which controls melting of the ceramic powders. The arc gas flow rates can be varied to control these parameters to achieve effective deposition. The power level controls the heat of the plasma and melting of the ceramic powders. Accordingly, the power level and the gas flow rates are both important to achieve good melting of the ceramic powders.

The powder feed rate can be adjusted to control the rate of deposition of the ceramic coating 364. For example, a deposition of less than about 25 μm per pass during thermal spraying can typically achieve a ceramic coating 364 having good quality.

The standoff distance is the distance between the thermal spraying device and the surface on which the ceramic coating 364 is applied, i.e., the surface of the core 362 or of the sublayer 366. This distance controls the travel distance of the molten ceramic material before impinging on the surface being coated and the amount of time the molten ceramic materials remain in the plasma. The standoff distance can be selected based on the other coating parameters including the gas flow rates, power level and powder feed rate.

During thermal spraying of the ceramic coating, the spraying device is oriented at a suitable angle relative to the core 362 or sublayer 366 to obtain the desired thickness of the ceramic coating 364. A typical angle for this purpose is about 90°.

Exemplary embodiments of the coating processes of this invention for forming the ceramic coating 364 on the core 362 can utilize the following typical parameters: power level of about 10–15 kW, argon gas flow rate of about 70–120 scfh, helium gas flow rate of about 25–45 scfh, carrier gas flow rate of about 6.5–10.0 scfh, gun standoff distance of about 3–5 in, powder feed rate of about 15–25 g/min and a suitable surface speed of the core 362.

Other thermal spraying processes than plasma spraying processes may also be used to form the ceramic coatings 364. One suitable alternative thermal spraying process is high-velocity oxy-fuel (HVOF) processes. HVOF processes can be used to form the ceramic coatings 364 on the core 362 in some embodiments, or on the sublayer 366 in other embodiments.

HVOF processes use a fuel gas and oxygen to create a combustion flame. HVOF processes generate a high-velocity gas stream that propels the molten ceramic powder onto the substrate. The molten particles imbed themselves on the substrate.

Suitable fuel gases for the HVOF processes include, but are not limited to, hydrogen and propylene. Propylene can produce ceramic coatings 364 having a slightly higher conductivity than those formed using hydrogen.

HVOF processes can be used in methods according to this invention to form ceramic coatings 364 formed of single ceramic materials, such as stabilized zirconia, and also ceramic coatings 364 comprising blends of ceramic materials, such as zirconia/titania and alumina/titania blends. HVOF processes can be used to form ceramic coatings 364 that have suitable electrical characteristics, such as those that can be formed by plasma spraying. HVOF processes can form ceramic coatings 364 that are more dense than those formed by plasma spraying. In addition, ceramic coatings 364 formed by HVOF processes can typically be smoother than those formed by plasma spraying.

Typically, the ceramic material powders used in HVOF processes according to this invention are fine powders. For example, the ceramic material powders can typically have a particle size of less than about 30 $\mu$m to provide good ceramic coatings 364.

Typical standoff distances used for HVOF processes according to this invention are from about 3 in to about 9 in. For HVOF processes utilizing hydrogen gas, typical flow rates of oxygen are from about 300 scfh to about 700 scfh, and typical flow rates of hydrogen are from about 1200 scfh to about 1800 scfh. For HVOF processes utilizing propylene gas, typical flow rates of oxygen are from about 300 scfh to about 800 scfh, and typical flow rates of propylene are from about 100 scfh to about 300 scfh.

The ceramic coating 364 can be applied to cover substantially the entire outer surface of the core 362. In some embodiments, however, it may be desirable to coat most of the outer surface of the core 362, but to leave selected uncoated regions on the outer surface of the core 362, such as near the ends 360 of the donor roll 354.

Before the ceramic coating 364 is formed over the core 362 by thermal spraying, the journals 368 are typically masked to avoid overspray on the donor roll 354 shaft. During the coating process, the core 362 is rotated at a suitable rotational velocity. The core 362 is typically preheated prior to applying any ceramic coating 364 on the core 362. A typical preheat temperature of the core 362 is at least about 80° F. During the thermal spraying process, the coated core 362 is cooled so that its temperature does not exceed a temperature typically above about 300° F. The ceramic coating 364 is typically applied in multiple passes until the desired thickness of the ceramic coating 364 is achieved. The masks can then be removed from the journals 368.

The end faces 360 of the core 362 are typically also coated. In exemplary embodiments of the methods of forming the donor rolls 354 according to this invention, the end faces 360 are coated with a facecoat material prior to forming the ceramic coating 364 on the cylindrical surface of the core 362. This facecoat process provides at least two advantages. A first advantage is that the facecoat material can be applied to the end faces 360 with substantially no facecoat material being applied on the cylindrical surface of the body 356 of the core 362, i.e., with substantially no overspray onto the cylindrical surface. The elimination of overspray onto the core 362 reduces the cycle time of the machining step performed after the coating step because an extra coating thickness from the overspray is not formed on the core 362.

A second advantage is that the cylindrical surface of the core 362 can then be coated with the ceramic coating 364 within the same process that is used to coat the end faces 360. By coating both the end faces 360 and the cylindrical surface of the core 362 in the same process, cycle time for the coating process can be reduced as compared to performing these coatings in separate operations.

The composition of the material that is applied as the facecoat on tile end faces 360 of the core 362 is typically the same material as is applied as the ceramic coating 364. However, in some embodiments of the donor roll 354, the facecoat composition can be different from the ceramic coating 364 composition.

In addition, the facecoat can be applied to the end faces 360 by the same thermal spray process as used to form the ceramic coating 364 on the cylindrical surface of the core 362. In embodiments of the donor roll 354 including a sublayer or bondcoat 366 as described in detail below, the facecoat is applied on the end faces 360 of the core 362 before the sublayer or bondcoat 366 is applied on the cylindrical surface of the core 362.

Different thermal spraying process parameters are typically used during the facecoating process to at least substantially eliminate the occurrence of overspray onto the core 362. The elimination of overspray on the core 362 can be achieved by using suitable angles of the thermal spraying device, such as a plasma spraying gun, suitable gun standoff distance and suitable direction of spray.

In some embodiments of the donor rolls 354 according to this invention, the ceramic coating 364 is applied onto the core 362 after a suitable surface finish has been formed on the core 362. Typically, the core 362 outer surface is prepared, such as by gritblasting, to provide a suitable surface for applying the ceramic coating 364 onto the core 362. A suitable roughness of the surface of the core 362 on which the ceramic coating 364 is applied is typically about 3 $\mu$m or more. This roughness level of the surface of the core 362 is typically suitable to achieve sufficient mechanical interlocking with the ceramic coating 364 to provide good adhesion.

Exemplary embodiments of the methods of gritblasting the core 362 prepare the core 362 for the application of the ceramic coating 364 and contribute to achieving a consistent runout of the donor roll 354. Typical gritblasting parameters for metal cores 362, such as aluminum cores 362, include aluminum oxide grit, a grit size of 70, a blasting pressure of about 40 psi, a nozzle distance of about 3.5 in and a traverse speed of about 13 in/min. The core 362 can be cleaned of impurities by any suitable technique, such as grit blasting using a fluid that is free of contaminants. Media can be replenished by filtration.

In other exemplary embodiments of the donor roll 354, the sublayer 366 can be applied on the core 362 to enhance the adhesion of the ceramic coating 364 on the core 362.

The sublayer 366 can comprise a mixture of metallic and ceramic materials that provides good adhesion of the ceramic coating 364 on the core 362. Mixtures of metallic and ceramic materials that have a low work function and a high affinity for oxygen are suitable for forming sublayers 366 for ceramic coatings 364, which are n-type semiconductors. Suitable metals for forming the sublayers 366 on metallic cores 362 such as aluminum cores include, for example, Ti, Al, Zn, Ga and Cr. The ceramic material of the sublayer 366 can be the ceramic material forming the ceramic coating 364 so that the sublayer 366 forms a mechanical bond with the ceramic coating 364. The sublayer 366 provides ohmic contact of the ceramic coating 364 with the core 362.

The sublayer 366 can be applied on the core 362, typically after the core has been subjected to precision grinding, by any suitable thermal spraying technique. The sublayer 366 forms a textured surface. For metallic cores 362, the metal in the sublayer 366 adheres to the core 362 and the ceramic in the sublayer 366 forms a bond with the ceramic coating 364.

In some exemplary embodiments, the donor roll 354 can also comprise a protective overcoat applied over the ceramic coating 364. Suitable overcoats are described in U.S. application Ser. No. 09/364,297, filed on Jul. 30, 1999, and incorporated herein by reference in its entirety. The overcoat is applied to prevent, or at least reduce the effects of, wear and moisture penetration. In addition, the overcoat can be applied to tune the physical properties and performance characteristics of the ceramic coating 364, including, for example, friction and conductivity. Suitable exemplary overcoat materials include waxes, polymeric resins and metal oxides.

The cooling rate of the ceramic coating 364 can be controlled to reduce the thermal differential between the core 362 and the ceramic coating 364, to thereby reduce the generation of thermal stresses in the ceramic coating 364. Cooling can be controlled by directing a gas flow onto the core 362 during the coating process. In addition, the core 362 can be preheated to a suitable temperature to reduce the thermal differential between the core 362 and the ceramic coating 364. Preheating the core 362 also promotes the adhesion of the ceramic coating 364. Typically, the temperature of the core 362 and the ceramic coating 364 are maintained below about 300° F. to achieve a suitable thermal differential and good coating adhesion.

The thickness of the ceramic coating 364 as formed on the core 362 by the thermal spraying process is typically from about 75 $\mu$m to about 450 $\mu$m. In some exemplary embodiments of the donor roll 354, the ceramic coating 364 has a thickness of from about 100 $\mu$m to about 400 $\mu$m as applied on the respective core 362.

An unfinished donor roll 354 typically has an arithmetic mean roughness Ra of from about 3 $\mu$m to about 7 $\mu$m. This surface smoothness level may not be completely satisfactory for some high-precision electrostatographic development applications. Accordingly, in some exemplary embodiments of the ceramic coating 364, the ceramic coating 364 formed on the respective core 362 by a thermal spraying process is finished by a machining process to achieve a desired final finish having a suitable low roughness. The ceramic coating 364 provides the advantage that a highly smooth surface finish can be formed using known grinding and polishing techniques.

The ceramic coating 364 can be finished to achieve the desired surface roughness. In such embodiments, the final thickness of the ceramic coating 364 is less than its applied thickness. Accordingly, the applied thickness of the ceramic coating 364 is selected to compensate for the coating material that is removed by the finishing process.

Figure 8:
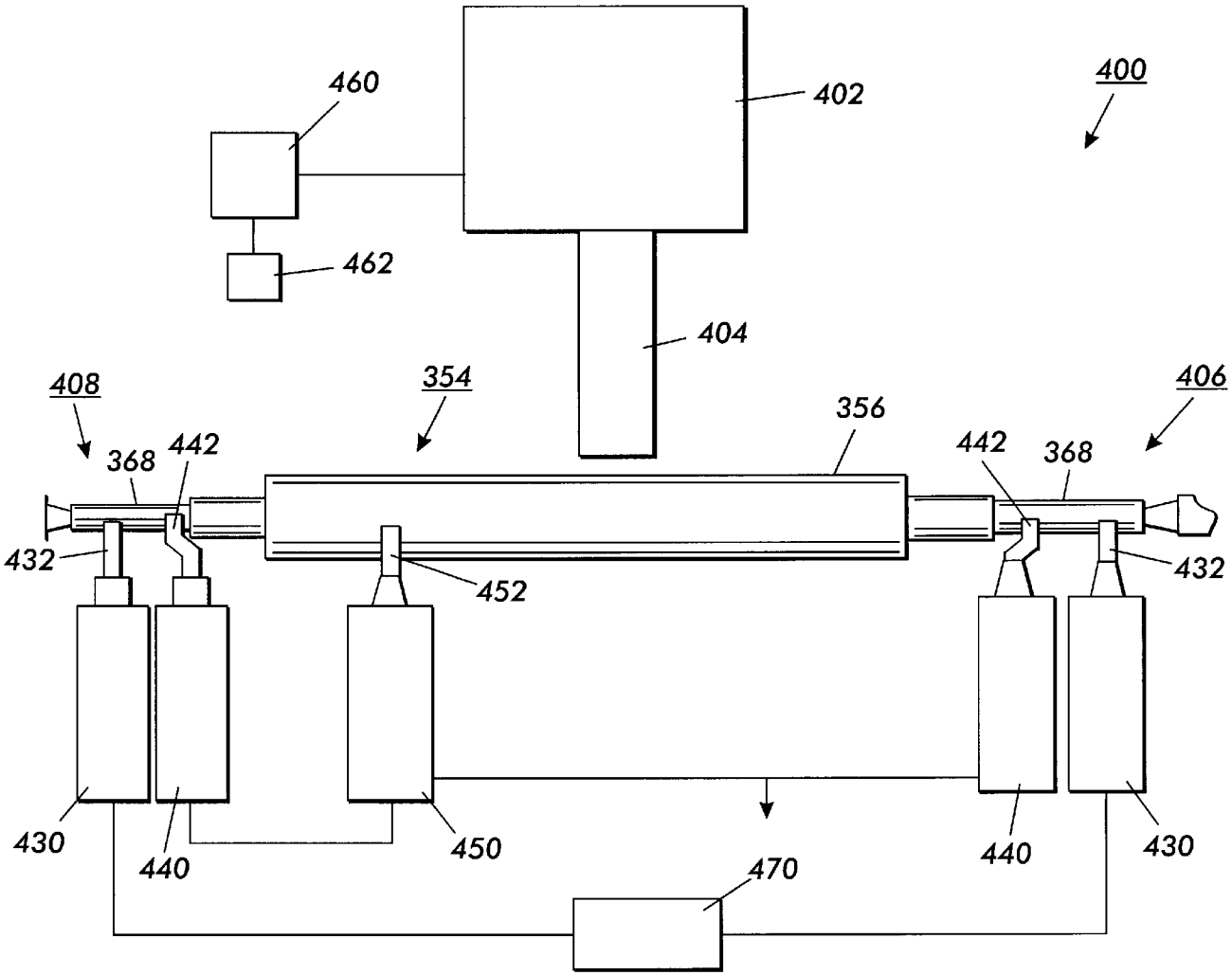
FIG. 8 illustrates an exemplary embodiment of a grinding system according to this invention for grinding donor rolls.

Exemplary embodiments of the apparatus and methods for finishing the ceramic coating 364 according to this invention can achieve donor rolls 354 having a reduced runout and improved dimensional tolerance. An exemplary embodiment of a grinding system 400 according to this invention for finishing the donor roll 354 is shown in FIG. 8. The grinding system 400 includes a grinding device 402 for grinding the ceramic coating 364. A suitable grinding device 402 for grinding the core 362 and journals 364 is a Weldon Model No. 1632 cylindrical grinder. For grinding the ceramic coating 364, a grinding element 404 that can provide the desired surface finish on the ceramic coating 364 is used. For example, the grinding element 404 can be a diamond wheel. For grinding the journals 368, a silicon carbide grinding wheel is typically used. A suitable grit for the grinding wheel is typically 36 grit.

The grinding device includes a hydraulic tailstock 406 that supports the body 356 and journals 368 of the donor roll 354 at the end opposite to the headstock 408, at which the core 362 and journals 368 are driven.

Figure 9:
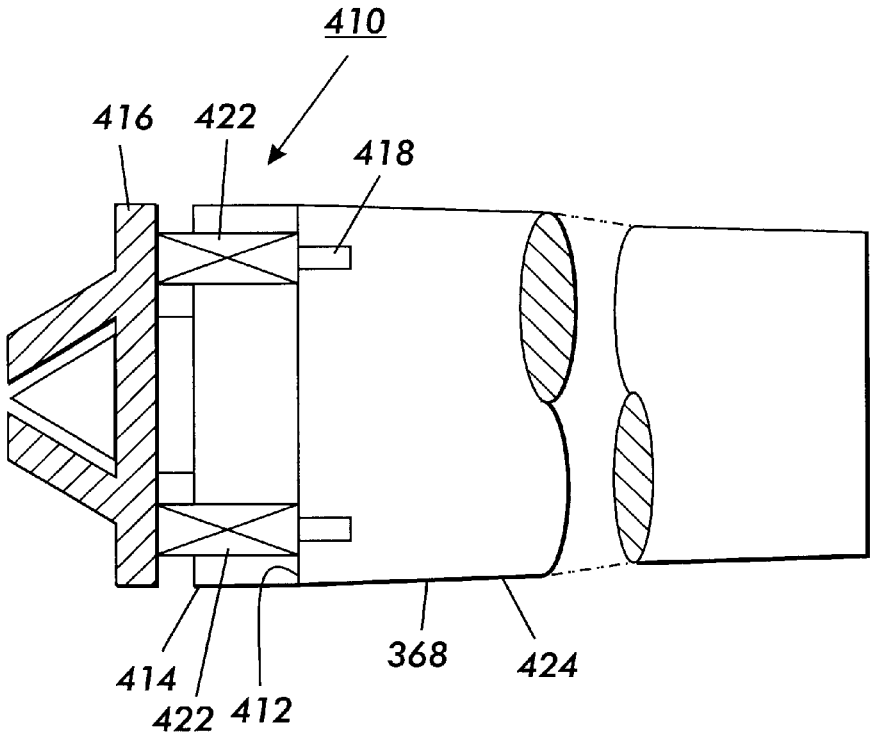
FIG. 9 illustrates an exemplary embodiment of a face driver according to this invention attached to an end of a journal of a donor roll.
Figure 10:
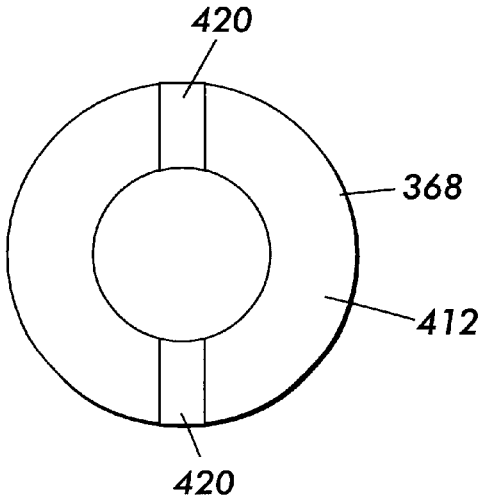
FIG. 10 shows slots formed in the end of a journal of a donor roll.

Referring to FIG. 9, the body 356 and journals 368 are driven at the headstock by a non-destructive face driver 410 that is mounted to the end 412 of the journal 368, opposite to the end of the journal 368 that is inserted into the bore 372 formed in the core 362. The face driver 410 includes a drive center 414 and a drive dog 416 attached to the drive center 414. Referring to FIG. 10, the drive center 414 includes tabs 418 that engage slots 420 formed in the end 412 of the journal 368. The drive center 414 also includes springs 422 to provide precision location of the core 362 and journals 368 on center while the drive center 414 floats to engage the slots 420 in the journal 368. The face driver 410 engages the end 412 of the journal 368 and does not cover any portion of the cylindrical surface 424 of the journal 368. Consequently, the cylindrical surface 424 can be ground to close tolerances along its length and up to the position of the face driver 410.

Figure 11:
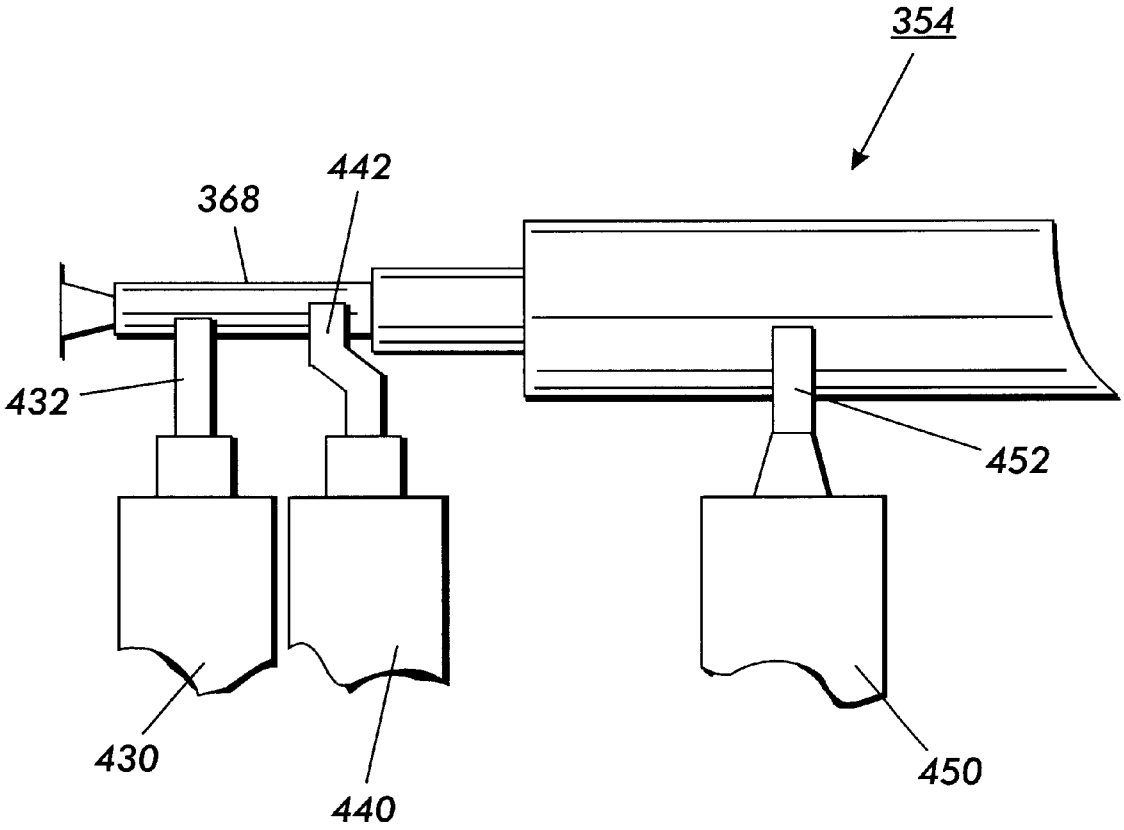
FIG. 11 is an enlarged view of a portion of the grinding system of FIG. 8.
Figure 12:
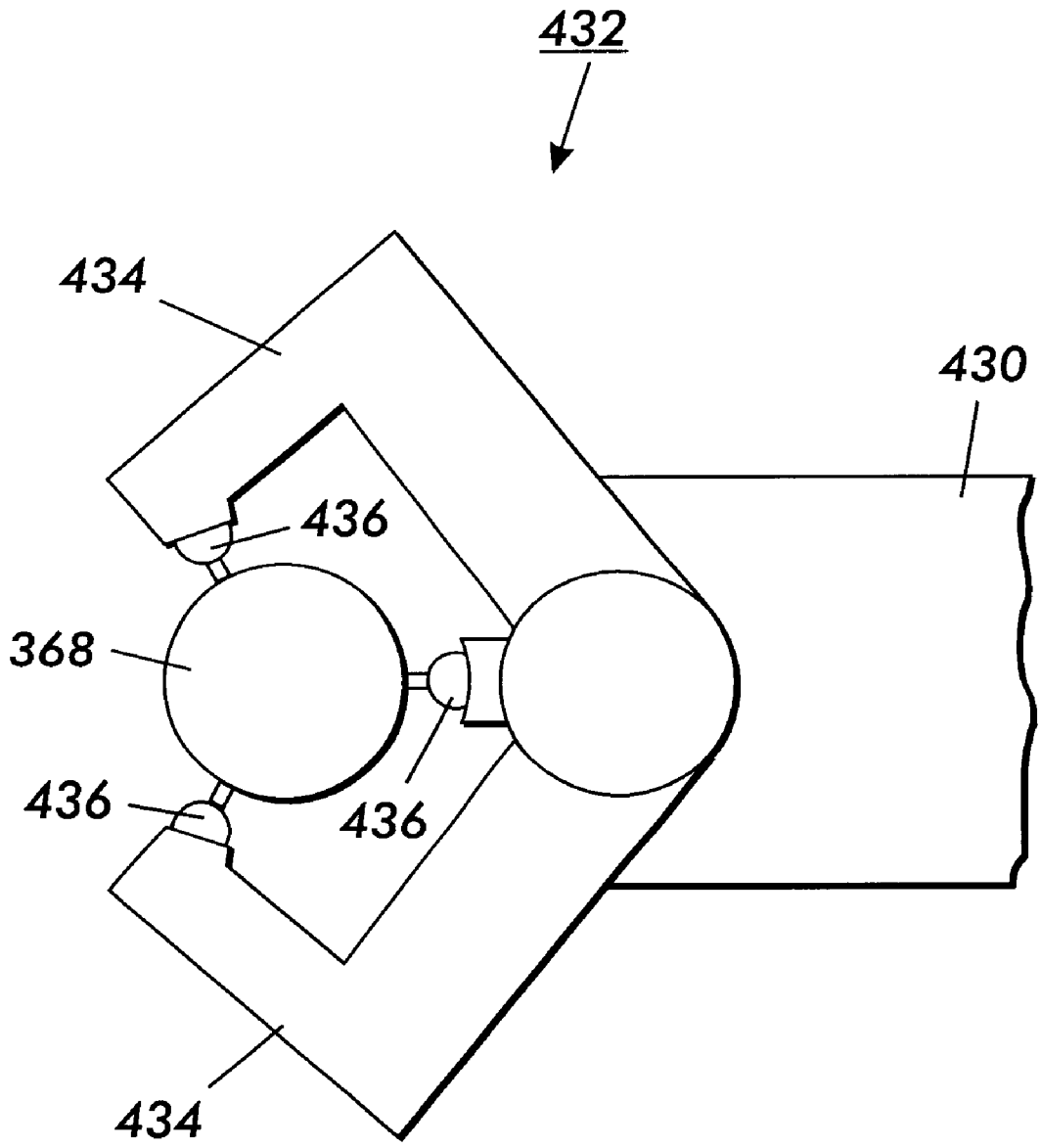
FIG. 12 illustrates a portion of a rest for supporting a journal of the donor roll shown in FIG. 8.

As shown in FIG. 8, during grinding, the body 356 and journals 368 of the donor roll 354 are steadily supported by rests 430 that engage the journals 368. As shown in greater detail in FIGS. 11 and 12, the rests 430 comprise rigid holding clamps 432 that engage the journals 368 to provide support to the journals 368 and prevent the core 362 and journals 368 from deflecting during grinding due to grinding pressures applied by the grinding element 402 that tend to push the donor roll 354 away from the grinding element 402. The holding clamps 432 include arms 434 with fingers 436 that contact the journals 368, to maintain the journals steady and substantially prevent any movement of the journals 368 during grinding.

Suitable rests 430 for use in the grinding system are model GR050MR5CL hydraulic rests available from Arobotech (Madison Heights, Mich.).

Figure 14:
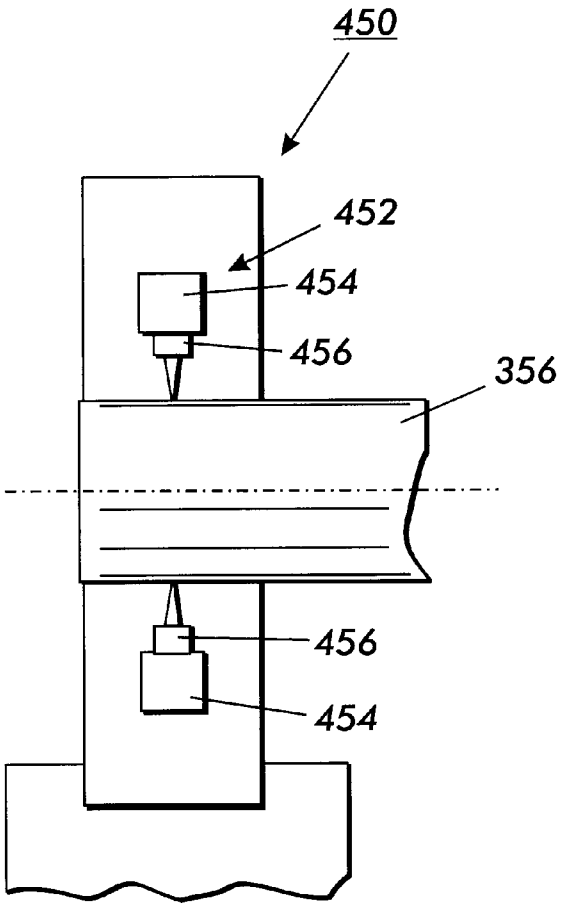
FIG. 14 is a side view of the gauge of FIG. 13.
Figure 13:
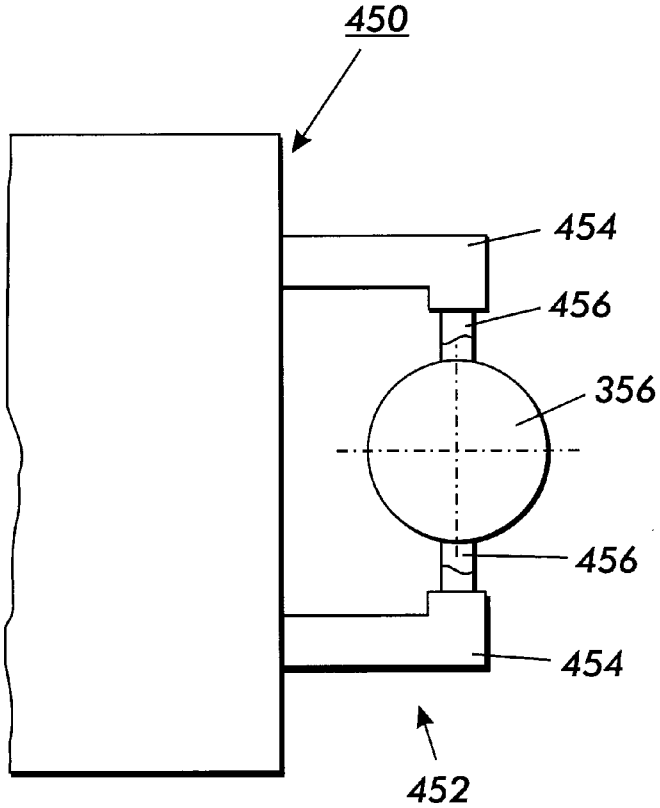
FIG. 13 is an end view of a portion of the gauge engaging the core of the donor roll shown in FIG. 8.

The grinding system 400 also includes gauges 440 that extend onto the journals 368 and a gauge 450 that extends onto the body 356. The gauges 440 and 450 measure the diameter of the journals 368 and the body 356, respectively, during grinding. The gauges 440 and 450 include respective gauge members 442 and 452 shown in FIG. 11. As shown in FIGS. 13 and 14, the gauge member 452 includes arms 454 and with fingers 456 that touch the body 356.

Suitable gauges 440 and 450 for use in the grinding system 400 are model CR60 gauges available from Etamic Plymouth, Mich.). These gauges are electronic and can automatically extend onto the journals 368 and body 356 to measure the diameter of the journals 368 and body 356 during the grinding process.

During grinding of the donor roll 354, fine ceramic particles are removed from the ceramic coating 364. In addition, fine particles are also removed from the grinding element 404. The ceramic particles from the ceramic coating 364 are very hard and can be as large as 10 $\mu$m. The grinding system 400 includes a filtration system 460 to filter the ceramic coating particles and the particles removed from the grinding element 404 from the coolant supply to prevent these particles from being recycled and acting as an abrasive during subsequent grinding operations. An exemplary embodiment of the filtration system 460 includes a plurality of canister filters. Suitable cannister filters for use in the filtration system 460 are available from Ronningen Patter (Portage, Mich.). The filtration system 460 can remove all particles larger than about 1 μm and accordingly can remove the ceramic particles that are removed from the ceramic coating 364 during grinding.

The filtration system 460 can also include a coolant chiller 462 to cool the clean water supply used in filtration system to a suitable low temperature of the grinding coolant. Typically, the coolant chiller 462 can maintain the coolant at a temperature of less than about 72° F., even after extended operation of the grinding system. By controlling the temperature of the grinding coolant, improved performance of the rests 430 can be achieved, resulting in more steady support of the donor roll 354 during grinding.

In order to achieve suitable filtration of the coolant, embodiments of the filtration system typically include storage vessels for both dirty and clean coolant. For example, embodiments of the storage vessels can provide for 1000 gallon filtration capabilities and automatic backflushing, by providing a 700 gallon vessel for dirty coolant and a 300 gallon vessel for clean coolant.

Any suitable coolant can be used. An exemplary suitable coolant is Syntillo 9954 available from Castro (Downers Grove, Ill.).

Embodiments of the grinding system 400 can also include an oil chiller 470 to cool the hydraulic oil used in the grinding device. The oil chiller 470 controls the temperature of the hydraulic oil used in the grinding device 402 and the rests 430, to improve their performance. Particularly, the oil chiller 470 can maintain the hydraulic oil temperature at the desired temperature during prolonged operation of the grinding system 400. Typically, the coolant temperature is maintained in the range of from about 65° F. to about 75° F. Consequently, the rests 430 are able to more steadily support the donor roll 354 during grinding, resulting in reduced rinout and improved dimensional tolerances of the donor rolls 354.

Exemplary embodiments of the methods of grinding and finishing the ceramic coatings 364 and journals 368 can include the following steps. After the body 356 with attached journals 368 is loaded into the grinding device 402, the journals 368 are rough ground. Next, the core 362 and journals 368 are engaged with the rests 430. The journals 368 are finish ground to the desired size. Next, the ceramic coating 364 is rough ground to the desired finish. Next, the ceramic coating 364 is finish ground. The donor roll 354 is then unloaded from the grinding device 402. Typically, the donor roll 354 is then cleaned using ultrasonic cleaning, an alkaline wash cycle, or a hand wipe.

Exemplary embodiments of the methods of grinding the core 362 and journals 368 can use the following parameters to achieve suitable core 362 and journals 368 surface finishes. For dressing, exemplary suitable parameters are: rotation speed—about 1700 rpm, traverse speed—500 mm/min, and relief—about 5°.

For grinding the core 362, exemplary suitable parameters are: grinding wheel rotation speed—about 1500 rpm, core rotation speed—about 200 rpm, multiple rough passes, infeed—about 0.05 mm, traverse speed—about 300 mm/min, at least one finish pass, about 0.02 infeed, and traverse speed—about 300 mm/min.

For grinding the journals, exemplary suitable parameters are: dressing wheel velocity—about 2300 rpm, traverse speed—about 200 mm/min, straight dress and feed—about 0.01.

For grinding the ceramic coating 364, exemplary suitable parameters that can be used to achieve a suitable finish are: rough part speed—about 200 rpm, finish part speed—about 150 rpm, grinding wheel (diamond) speed—about 1430 rpm, finish traverse speed—300 mm/min, rough traverse speed—300 mm/min, truing wheel speed—about 20 m/s, rotary dresser speed—about 2700 rpm, infeed—0.005 mm/0.002 mm, feed rate—about 225 mm/min, wheel profile—0.05 mm radius on both grinding wheel corners, and suitable rough and finish grinding paths.

For grinding the shaft of the donor roll 354, exemplary suitable parameters that can be used to achieve a suitable finish are: part speed—about 80 rpm, grinding wheel (SiC) speed—about 2300 rpm, infeed/plunge about 0.02, truing wheel speed—about 2300 rpm, infeed rate—about 0.002 mm, feedrate—about 200 mm/min, wheel profile—flat.

The donor rolls 354 according to this invention provide reduced runout, improved dimensional uniformity, and improved uniformity of thickness of the ceramic coatings 364.

To measure the runout of a donor roll 354, the donor roll 354 roll is staged, i.e., supported. Typically, the donor roll 354 is staged on the journals 368 on a datum. The runout is typically measured at multiple locations of the staged donor roll 354. For example, the runout can typically be measured at three separate locations; namely, at a first location at a selected distance from one end of the body 356, a second location at a selected distance from the opposite end of the body 356, and a third location at about the longitudinal center of the body 356. Typically, the first and second locations are each about 10 mm inward from the respective end of the body 356. Each of the multiple separate measurements at the different locations on the body 356 is a separate total indicator reading. The cumulative runout, also known as the composite runout, is derived by placing an indicator on the body 356, setting the indicator to zero, and then rotating the roll 354 by one full rotation, i.e., by 360 degrees as the indicator is moved along the roller. The total movement away from zero for the reading, both + and −, is the composite runout.

In some exemplary embodiments of the donor rolls 354, the composite runout of the donor rolls 354 can be less than about 20 μm. In addition, the donor rolls 354 can have a total indicator reading runout of less than about 7 μm.

Furthermore, in some exemplary embodiments of the donor rolls 354, the outer diameter of a given donor roll 354 can have a tolerance of less than about 5 μm along the length of that donor roll 354. In addition, a roll-to-roll deviation of the outer diameter of different donor rolls 354 of about ±40 μm can be achieved in some embodiments of the donor rolls 354. In other embodiments of the donor rolls 354, a roll-to-roll variation of the outer diameter of less than about ±20 μm can be achieved.

In addition, in exemplary embodiments of the donor rolls 354 according to this invention, the ceramic coatings 364 can have a thickness uniformity of from about 10 μm to about 70 μm. In other exemplary embodiments of the donor rolls 354 according to this invention, the ceramic coatings 364 can have a thickness uniformity of from about 10 μm to about 25 μm.

Due to their improved features including runout, dimensional uniformity and ceramic coating 364 thickness uniformity, the donor rolls 354 according to this invention thus can provide improved toner transfer characteristics to photoconductive members, making the donor rolls 354 highly suitable for use in various types of scavengeless development systems, including both single and double-component developer material systems.

However, it will be appreciated by those skilled in the art that the donor rolls 354 can be also be used in various other imaging and printing apparatus, including color printing, that would benefit from the improved characteristics of the donor rolls 354. The donor rolls 354 can be included in various types of electrostatographic imaging apparatus, including digital systems.

While the invention has been described in conjunction with the specific embodiments described above, it is evident that many alternatives, modifications and variations are apparent to those skilled in the art. Accordingly, the preferred embodiments of the invention as set forth above are intended to be illustrative and not limiting. Various changes can be made without departing from the spirit and scope of the invention.

What is claimed is:

1. A roll, comprising:

a core including opposed ends;

a journal attached at each of the opposed ends of the core; and a ceramic coating formed over the core;

wherein when the roll is staged on the journals on a datum, the roll has a composite runout of less than about 20 $\mu$m.

2. The roll of claim 1, wherein when the roll is staged on the journals on a datum, the roll has a total indicator reading runout of less than about 7 $\mu$m.

3. The roll of claim 2, wherein:

the core is cylindrical shaped; and the ceramic coating has an outer diameter with a tolerance of less than about 5 $\mu$m along the length of the ceramic coating.

4. The roll of claim 1, wherein:

the core is cylindrical shaped; and the ceramic coating has an outer diameter with a tolerance of less than about 5 $\mu$m along the length of the ceramic coating.

5. The roll of claim 1, wherein the ceramic coating consists essentially of a single ceramic material.

6. The roll of claim 5, wherein the ceramic coating consists essentially of stabilized zirconia.

7. The roll of claim 1, wherein the ceramic coating comprises a blend of ceramic materials.

8. The roll of claim 7, wherein the ceramic coating comprises a blend of at least 75 wt % of the stabilized zirconia and titania.

9. The roll of claim 7, wherein the ceramic coating comprises a blend of alumina and titania.

10. The roll of claim 1, wherein the ceramic coating has an arithmetical mean roughness Ra of less than about 0.7 $\mu$m and a maximum waviness Wt of less than about 1 $\mu$m.

11. The roll of claim 1, wherein the ceramic coating has an electrical resistivity of from about $10^3$ Ω·cm to about $10^{10}$ Ω·cm.

12. The roll of claim 1, wherein:

the roll further comprises a sublayer formed on the outer surface of the core, the sublayer comprises a metal and a ceramic material that is also included in the ceramic coating; and the ceramic coating is formed on the sublayer;

wherein the sublayer enhances adhesion of the ceramic coating to the core.

13. The roll of claim 1, wherein the ceramic coating has a thickness uniformity of from about 10 $\mu$m to about 70 $\mu$m along the length of the ceramic coating.

14. The roll of claim 13, wherein the ceramic coating has a thickness uniformity of from about 10 $\mu$m to about 25 $\mu$m along the length of the ceramic coating.

15. The roll of claim 1, wherein the roll is a charge donor roll.

16. An electrostatographic imaging apparatus, comprising:

a photoconductive member on which a latent image is formed; and a roll according to claim 1 for transferring toner to the photoconductive member.

17. A method of making a roll, comprising:

a) forming a ceramic coating over a core of a body including a journal attached to each one of opposed ends of the core; and b) finishing the ceramic coating such that when the roll is staged on the journals on a datum, the roll has a composite runout of less than about 20 $\mu$m.

18. The method of claim 17, wherein the ceramic coating is finished such that when the roll is staged on the journals on a datum, the roll has a total indicator reading runout of less than about 7 $\mu$m.

19. The method of claim 18, wherein:

the core is cylindrical shaped;

the ceramic coating has an outer diameter; and the ceramic coating is finished such that the outer diameter has a tolerance of less than about 5 $\mu$m along the length of the ceramic coating.

20. The method of claim 19, further comprising:

repeating (a) and (b) to make another roll having a cylindrical shape and including a ceramic coating having an outer diameter;

wherein the outer diameter of the another roll has a tolerance of less than about 5 $\mu$m along the length of the ceramic coating of the another roll; and wherein the outer diameters of the roll and the another roll vary by less than about ±40 $\mu$m from each other.

21. The method of claim 17, wherein the outer diameters of the roll and the another roll vary by less than about ±20 $\mu$m from each other.

22. The method of claim 17, wherein:

the core comprises a metallic material; and the method further comprises applying a sublayer on the core between the core and the ceramic coating, the sublayer comprises a metal and a ceramic material that is also included in the ceramic coating.

23. The method of claim 17, wherein forming the ceramic coating comprises applying the ceramic coating over the core by thermal spraying to achieve a selected resistivity of the ceramic coating.

24. The method of claim 23, wherein forming the ceramic coating comprises applying the ceramic coating over the core by a high-velocity oxyfuel process to achieve a selected resistivity of the ceramic coating.

25. The method of claim 17, wherein:

the core is cylindrical shaped and includes opposed end surfaces and a cylindrical surface extending between the end faces; and the method further comprises:

applying a facecoat material to the end surfaces of the core such that substantially no facecoat material is deposited on the cylindrical surface; and then applying the ceramic coating on the cylindrical surface.

26. The method of claim 17, wherein the ceramic coating consists essentially of a single ceramic material.

27. The method of claim 17, wherein the ceramic coating comprises a blend of ceramic materials.

28. The method of claim 17, wherein the ceramic coating has an arithmetical mean roughness Ra of less than about 0.7 μm and a maximum waviness Wt of less than about 1 μm.

29. The method of claim 17, wherein finishing the ceramic coating comprises:

grinding the ceramic coating while supporting the core in a substantially fixed position;

applying a coolant to the ceramic coating during the grinding; and removing substantially all particles larger than about 1 μm from the coolant during the grinding.

30. The method of claim 17, wherein the ceramic coating has a thickness uniformity of from about 10 μm to about 70 μm along the length of the ceramic coating.

31. The method of claim 30, wherein the ceramic coating has a thickness 10 uniformity of from about 10 μm to about 25 μm along the length of the ceramic coating.

32. A roll, comprising:

a core;

a ceramic coating formed over the core;

wherein when the roll has a composite runout of less than about 20 μm.

33. The roll of claim 32, wherein when the roll has a total indicator reading runout of less than about 7 μm.

34. The roll of claim 32, wherein the ceramic coating consists essentially of a single ceramic material.

35. The roll of claim 32, wherein the ceramic coating consists essentially of stabilized zirconia.

36. The roll of claim 32, wherein the ceramic coating comprises a blend of ceramic materials.

37. The roll of claim 32, wherein the ceramic coating has a thickness uniformity of from about 10 μm to about 25 μm along the length of the ceramic coating.

38. The roll of claim 32, which is a charge donor roll.

39. An electrostatographic imaging apparatus, comprising:

a photoconductive member on which a latent image is formed; and a roll according to claim 32 for transferring toner to the photoconductive member.

* * * * *